United States Patent [19]

Geuns et al.

[11] 4,398,851

[45] Aug. 16, 1983

[54] ARRANGEMENT FOR CONTROLLING ADVANCING TIMBERING IN UNDERGROUND MINING

[75] Inventors: Guy Geuns, Hemhofen; Georg Rötzer, Erlangen, both of Fed. Rep. of Germany

[73] Assignee: Siemens Aktiengesellschaft, Munich, Fed. Rep. of Germany

[21] Appl. No.: 322,545

[22] Filed: Nov. 18, 1981

[30] Foreign Application Priority Data

Dec. 2, 1980 [DE] Fed. Rep. of Germany ..... 3045452

[51] Int. Cl.[3] ..... E21D 15/44

[52] U.S. Cl. ..... 405/302

[58] Field of Search ..... 405/302, 291–296; 299/1; 91/460, 461, 527

[56] References Cited

U.S. PATENT DOCUMENTS

| | | | |
|---|---|---|---|
| 3,306,050 | 2/1967 | Andrews et al. | 405/302 |
| 3,320,001 | 5/1967 | Allen et al. | 405/302 X |
| 4,050,256 | 9/1977 | Phillips et al. | 405/302 X |
| 4,109,472 | 8/1978 | Harris | 405/302 |
| 4,132,079 | 1/1979 | Ito et al. | 405/302 X |
| 4,134,270 | 1/1979 | Small et al. | 405/302 |
| 4,146,271 | 3/1979 | Ward et al. . | |
| 4,330,154 | 5/1982 | Harris | 299/1 |

FOREIGN PATENT DOCUMENTS

| | | | |
|---|---|---|---|
| 2228406 | 8/1973 | Fed. Rep. of Germany | 405/302 |
| 1065881 | 4/1967 | United Kingdom | 405/302 |

*Primary Examiner*—Dennis L. Taylor

*Attorney, Agent, or Firm*—Kenyon & Kenyon

[57] ABSTRACT

A system for advancing timbering in underground mines comprises a number of longwall supporting timbering units which are pushed forward hydraulically in accordance with the progress of the working obtained by a mining machine, along with a conveyer device. Each timbering unit is equipped with an electronic control device which is connected to a computer in a control room. The control units are connected in series via control lines in such a manner that the control data delivered by the computer and the acknowledgment data delivered by the respective addressed control unit are passed on via first receivers and transmitters and via second transmitters and receivers, respectively, from one control unit to the immediately adjacent one in ascending or descending sequence back to the computer.

10 Claims, 2 Drawing Figures

ARRANGEMENT FOR CONTROLLING ADVANCING TIMBERING IN UNDERGROUND MINING

BACKGROUND OF THE INVENTION

The invention relates to underground mining in general and more particularly to an arrangement for controlling advancing timbering.

For adapting to the progress of a mine being worked by means of a mining machine, the timbering units, for instance, the timber frames, are equipped with hydraulic cylinders which must fulfill the following functions: Drawing the timbering, pushing the timbering forward, setting the timbering, advancing the conveyer and, optionally, extending the support cars. These functions can be triggered via, for instance, electromagnetically operated valves from a longwalling control room or also at the site. A longwall timbering system comprises a number of timbering units which can be controlled individually or by groups to obtain the advancing process.

An arrangement for controlling advancing timbering in underground mines comprising: a plurality of control units, one assigned to each timbering units, which can be selected individually and each of which contain an electronic evaluation circuit; and a control room (or central control) which is equipped with a system which transmits control data delivered by a computer serially to the control units, is also equipped with a device indicating the state of the timbering, and with an input device for selecting the computer program, is described in DE-OS No. 27 36 365.* In the disclosed system, the control units are built up from electronic components and connected to the computer in the control room via a cable with a multiplicity of conductors, to each of which a task is assigned such as data transmission, power supply, timing, etc. This design of the control units is expensive, and due to the parallel connection to the cable, which is common to all control units, in the case of trouble it is difficult to determine at which control unit or in which cable section the trouble has occurred.

*=U.S. Pat. No. 4,146,271

It is an object of the present invention to produce a system for the control for longwall timbering in such a manner that the control data can be transmitted at the lowest possible cost without interference, and operating disturbances can be localized without elaborate measures.

SUMMARY OF THE INVENTION

According to the present invention, this problem is solved by connecting a first receiver which is arranged in each control unit and receives the control data, to the evaluation circuit and to a first transmitter which is connected via a control line to the first receiver of the immediately following control unit. A second transmitter in each control unit, delivers acknowledgment messages and is connected via a further line to a second receiver of the respective, immediately preceding control unit. The second transmitter can be connected via a switch to the evaluation circuit or to the second receiver of the control unit. The first receiver of the first control units is coupled to the central control as is the second transmitter of this first control unit.

With this design, short and uniform line sections between the individual control units are obtained. Since the control data are passed on sequentially from one control unit to the other and similarly, the acknowledgment messages in the opposite direction, trouble occurring on the transmission path can readily be localized.

Advantageously, the evaluation circuit includes a minicomputer, converters connected thereto for the parallel to serial and serial to parallel transmission of the control and acknowledgment data, and control logic. So that transmission of control data from one control unit to the immediately adjacent control units is possible if a disturbance in the control room or in the transmission channel leading to the control room occurs, each control unit contains, according to a further feature of the present invention, a third receiver for initiating data traffic between the control units of two adjacent timbering units, independent of the control room. Two further transmitters which can be connected to the evaluation circuit via a second switch, and two further receivers which can be connected to the evaluation circuit via a third switch, where the further transmitters are connected via a further line each to the corresponding further receiver of the adjacent control unit, form a second transmission path, independent of the control room.

DETAILED DESCRIPTION

Figure 1:
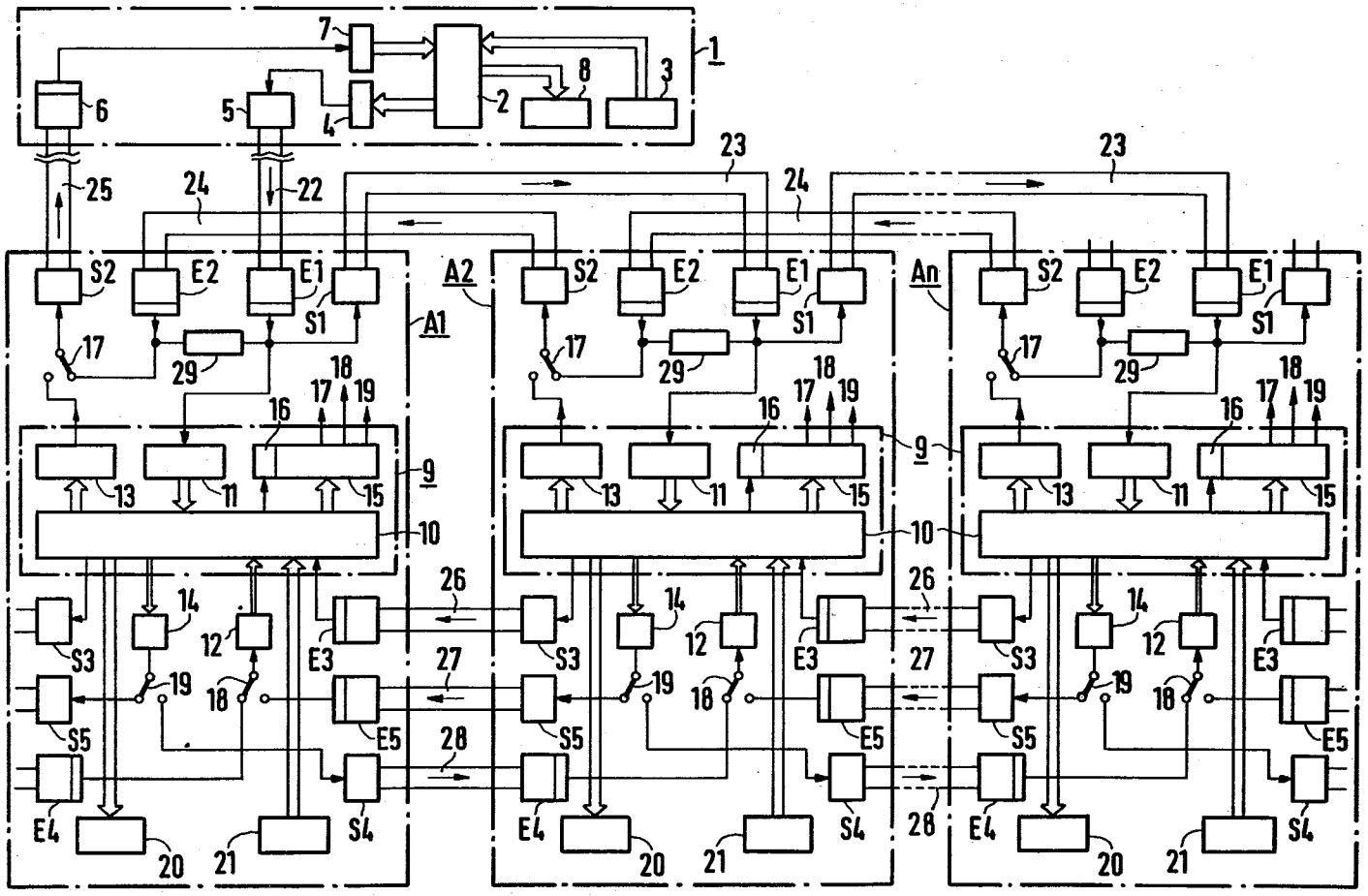
FIG. 1 is a block diagram of a first embodiment according to the present invention.

As shown in FIG. 1, a control room 1 and control units A1 to An for respective timbering units are provided for remotely controlling a face support. In the control room 1, a computer 2 is arranged, which is connected to an input unit 3, for instance, a keyboard, for calling up one of the control programs stored in the computer. The computer furnishes the control data corresponding to the selected program via a parallel to serial converter 4 to a transmitter 5. A receiver 6 receives the acknowledgment data arriving from the control units and transmits it via a serial to parallel converter 7 to the computer which evaluates this data and feeds signals characterizing the operating state of the timbering and walling to a display device 8.

According to FIG. 1, each of the control units contains five transmitters S1 to S5, five receivers E1 to E5 and one evaluation circuit 9 which comprises a minicomputer 10 with serial to parallel converters 11 and 12, parallel to serial converters 13 and 4, control logic 15 and supervisory logic 16. Switches 17, 18 and 19 are operated by the computer 10 via the control logic 15. The minicomputer 10 further addresses magnetic valves 20, with which the hydraulic drives of the timbering unit for causing the advancing processes, are associates. The advancing processes are monitored by sensors which deliver corresponding signals to the minicomputer. The sensors and a further keyboard for selecting programs at the site are indicated by the block 21.

The control data corresponding to the program selected by means of the keyboard 3, which consists of an address characterizing an individual control unit, an information part and a security part, is transmitted by the computer 2 in the control room to the parallel to serial converter 4 to be passed on to the transmitter 5. Transmitter 5 is connected via a control line 22 to the first receiver E1 of the control unit A1. The receiver E1 transfers the control data via the serial to parallel converter 11 to the minicomputer 10 and simultaneously to the first transmitter S1 of the control unit A1. The transmitter S1 of each of the control units other than the last one, i.e., the nth, is connected to the receiver E1 of the respective following control unit via a further control line 23. The control data delivered by the computer 2 is therefore passed on from one control unit to the next following one. The minicomputer 10 of each control unit examines the control data for its content. The minicomputer 10 of that control unit, the address of which agrees with the address given in the control data, operates its switch 17 via the control logic 15 and sends acknowledgment data to the control room via the transmitter S2. The control units which are not addressed receive the acknowledgement data delivered by the control unit selected from the transmitter S2 via their receiver E2 and pass on the data without further evaluation (with switch 17 in the position shown), via their transmitter S2 and a control line 24, to the receiver E2 of the respective preceding control unit until the first control unit A1 sends it to the control room. For this purpose, the transmitter S2 of the control unit A1 is connected via a control line 25 to the receiver 6 of the control room, which transmits the acknowledgment data to the computer 2 via the serial to parallel converter 7. The acknowledgment data is therefore passed on in the same manner as the control data from one control unit to the other. Thereby, faults occurring on the transmission path can be localized without difficulty and the line sections 23 and 24 always have the same length. The transmitters represent switchable voltage or current sources, while opto-electronic coupling elements are employed as receivers. The relatively short line sections (the distance between two control units is about 3 m) are terminated with low impedance and therefore ensure interference free data transmission.

As already mentioned, the minicomputer 10 of the addressed control unit, for instance, A2, delivers via the parallel to serial converter 13 and the switch 17, now switched to the other position, acknowledgment data to the transmitter S2 which passes on the data via the receiver E2, the switch 17 and the transmitter S2 of the preceding control unit, for instance A1, to the receiver 6 of the control room. The computer 2 in the control room checks the acknowledgment data and, in the event of an error, outputs the original control data again. If the acknowledgment data fails to arrive, the computer decides that there is a fault.

Since the control units A1 to An are called up cyclically in sequence, the number of the individual controls included in the transmission path and of the connecting lines increases in a defined manner. It is thereby possible to simplify troubleshooting in the event of a disturbance. A further possibility for localizing faults is provided by a test facility 29 which monitors the outputs of the receivers E1 and E2 in each control unit and contains, for instance, light-emitting diodes for indicating faults.

The receivers E1 and E2 and the transmitters S1 and S2 of each of the control units are reserved, in FIG. 1, for the exchange of data between the control room and the individual control units. So that the control units can conduct a data exchange with the control units of the respective adjacent timbering units regardless of the cyclic call-up by the control room, each control unit is equipped with further transmitters S3 to S5 and further receivers E3 to E5 as well as with a separate keyboard. If the control units do not receive control data from the control room for an extended period of time, then they switch automatically to operation without the control room. To operate the control units at the site, a program stored in the minicomputer, for instance, is called up via the keyboard. The minicomputer of the selected control unit, for instance, A2, then furnishes a request to receive to the receiver E3 of the control unit preceding in the sequence, via the corresponding transmitter S3 and the connecting line 26, for instance, A1, which in turn switches the minicomputer of the control unit A1 to a state of receiving readiness for receiving from the adjacent timbering (in the example, A2). The minicomputer of the selected control unit, for instance, A2, then feeds, via the parallel to serial converter 14, the switch 19, the transmitter S5 and the line 27, control data to the receiver E5 of the preceding control unit, for instance, A1, the control logic 15 of which has switched over the switch 18 due to the receiving readiness of the minicomputer, so that the received control data arrives via the serial to parallel converter 12 at the minicomputer of the control unit A1. The minicomputer 10 of the control unit A1 feeds back acknowledgement data to the receiver E4 of the control unit A2 via the parallel to serial converter 14, the switch 19 which has likewise been switched over by the control logic, the transmitter S4 and the line 28. The acknowldgment data reaches the minicomputer via the switch 18, which is not switched over, and the serial to parallel converter 12 of the control unit A2. Each control unit grants priority to the reception of control data of the immediately preceding control unit. However, it is also possible to select with the keyboard a program which makes available, via the parallel to serial converter 14, the switch switched over by the control logic, the transmitter S4 and the receiver E4, a transmission path from a preceding control unit to the control unit following in the sequence. In this manner, every control unit can exchange data with the neighbor or neighbors to the left or right without utilizing the data transmission system of the control room. To the control logic 15 of each control unit is added monitoring logic 16 which takes over the security functions in the event of a failure of the minicomputer and ensures that the control data, outputted by the control room, of the right-hand neighbor is passed on, via the transmissions paths 23 and 24.

Figure 2:
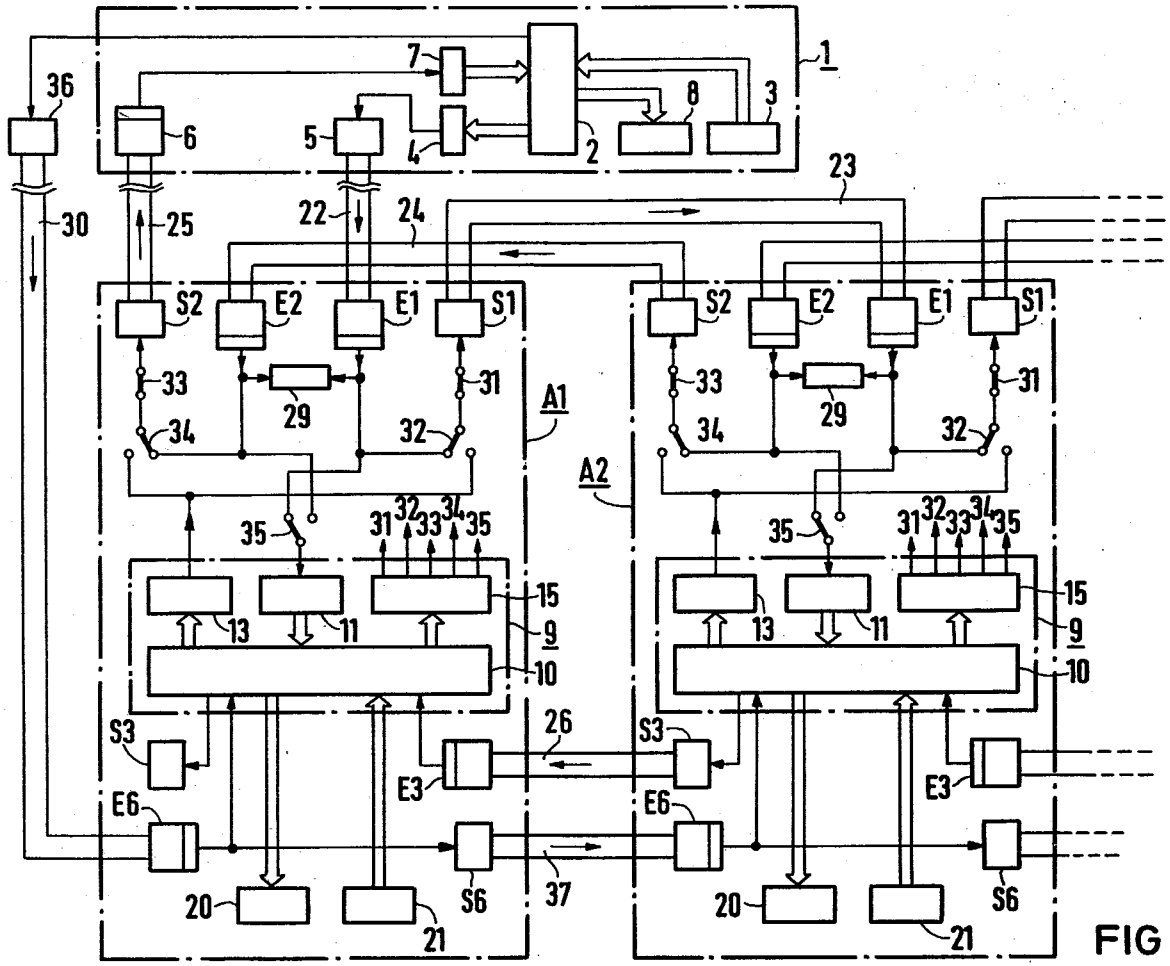
FIG. 2 is a block diagram of a second embodiment according to the present invention.

The control arrangement according to FIG. 2 differs from the one shown in FIG. 1 essentially by the feature that "operation with control room" or "operation without control room" is preselected from the control room and that only the lines 23 and 24 are used for the cyclic call up of the control units A1 to An by the control room as well as for the data exchange of the control units with the respective adjacent control units if the control room fails. For this purpose, the control room contains a further transmitter 36 which is connected via a control line 30 to a receiver E6 in the control unit A1 which is directly connected to the control room. Transmitter 36 transmit the chosen mode of operation to the minicomputer 10 of the control unit A1 through receiver 6. The chosen mode of operation is simultaneously transmitted by the transmitter S6 via the control line 37, to the receiver E6 of the following control unit, etc. The minicomputer 10 of the control units A2 to An then can, as described in connection with the embodiment according to FIG. 1, deliver a receiving request to the receiver E3 of the respective preceding control unit. A further difference is that, in every control unit, the receiver E1 is connected to the serial to parallel converter 11 through a switch 35 and to the transmitter S1 through switches 31 and 32 in series. In an analogous manner, the receiver E2 is connected to the transmitter S2 through switches 33 and 34 in series and to the serial to parallel converter through the switch 35. Control logic 15 controls switch 35. In the rest position of the switches 31 to 35 shown in the drawing, the receiver E1 transmits the arriving control data to the transmitter S1 of the control unit and at the same time it is coupled via the serial to parallel converter 11 to the minicomputer 10 of the control unit. The transmitter S1 of the control unit A1 passes the control data to the receiver E1 of the control unit A2, and so forth, until finally the control data reaches the control unit An.

In each of the control units, the control data is decoded. The control unit, the address of which agrees with the address contained in the control data, sends acknowledgment data to the control room. The control units which are not addressed pass the signals received via the receiver E2 in the respective control unit following in the sequence and its transmitter S2 directly to the control unit preceding in the sequence. To this end, the minicomputer of the addressed control unit switches the switches 33 and 34 via the control logic 15 in such a way that the data to be sent is coupled to the transmitter S2 through the parallel to serial converter 13. The transmitter S2 transmits the data processed by the computer to the receiver E2 of the respective preceding, not addressed, control unit, which passes on the data without examination to the control unit preceding it until, finally, the receiver 6 in the control room accepts the data. If "operation without control room" is set via the transmitter 36, then all control units are switched over to this mode of operation. If the control line 30 is interrupted, the control lines automatically recognize the mode of operation "operation without control room". In this case the transmission from and to the control room is inhibited, and every control unit can start a data exchange with its neighbors via the connecting lines 23 and 24 to the adjoining control units.

After being switched to "operation without control room", the minicomputer in each control unit first operates the switches 31 and 33 in such a manner, via the control logic, that the transmitters S1 and S2 are switched off and deliver only a rest signal. The switches 32 and 34 and 35 retain their rest position shown. Thereby, the minicomputer is ready to receive control data from the respective preceding control unit. If control data arrives from the preceding control unit, the computer of the receiving control unit can connect the transmitter S2 via the switches 33 and 34, which can be operated by the control logic, to the parallel to serial converter 13 and send acknowledgment data.

If a receiving request is delivered by the transmitter S3 to the preceding control unit, then the minicomputer of this control unit couples the receiver E2 via the switch 35 to the serial to parallel converter 11 and is therewith ready to receive. For sending acknowledgement data, the transmitter S1 is connected via the switches 31 and 32 to the parallel to serial converter 13.

For sending control data from one control unit to the next following one, a request to receive is not necessary. The minicomputer of the following control unit receiving the control data establishes, via the control logic and the switches 33 and 34, the connection between the transmitter S2 and the parallel to serial converter 13.

What is claimed is:

1. In an arrangement for controlling advancing timbering in an underground mine having n timbering units, comprising: a control unit for each of the n timbering units which can be selected individually, each control unit containing an evaluation circuit; and a central control room equipped with: a system for transmitting control data delivered by a computer serially to the control units; a device indicating the state of the timbering; and an input device for selecting the computer program, the improvement comprising, in each control unit:

(a) a first receiver coupled to receive control data having its output connected to the evaluation circuit, the input to the first receiver in the first control unit coupled to the central control room, (b) a first transmitter the first transmitters of the first $n-1$ control units having their outputs coupled via a control line to the inputs of the first receivers of the immediately following control units, each first transmitter having the output of the first receiver in its control unit as an input;

(c) a second transmitter having its output coupled to a further line, the further line of the second transmitter in the first control unit coupled to the central control room;

(d) a second receiver, the second receivers in the first $n-1$ control units having their inputs coupled to the further line which is connected to the second transmitter in the respective immediately preceding control unit; and (e) a first switch for controllably coupling said second transmitter respectively to the evaluation circuit and to the second receiver of its control unit.

2. The improvement according to claim 1, wherein said evaluation circuit comprises: a minicomputer; at least one serial to parallel and one parallel to serial converter connected thereto for transmitting control and acknowledgement data; and control logic.

3. The improvement according to claim 2, wherein each of said control units further includes: a third transmitter and a third receiver, the third transmitters and third receivers of adjacent control units coupled to each other for initiating data traffic between the control units of two adjacent timbering units, which is independent of the control room.

4. The improvement according to claim 3, and further including, in each control unit: fourth and fifth receivers and fourth and fifth transmitters; a third switch for selectively connecting one of said fourth and fifth transmitters to the evaluation circuit, each of said fourth and fifth transmitters other than the fifth transmitter in the first and the fourth transmitter in the nth control unit connected via a further line to a corresponding fourth or fifth receiver of the adjacent control unit.

5. The improvement according to claim 2, wherein each of said control units includes first and second further transmitters and first and second further receivers, the first further receiver in the first control unit receiving its input from the central control room and the remaining second through n receiving inputs from the first further transmitter in the preceding control unit, each first further receiver having its output coupled to its minicomputer and its first further transmitter, the second further transmitter of each but the first control unit providing its output to the second further receiver of the preceding control unit, each second further transmitter receiving its input from its minicomputer and each second further receiver providing its output to its minicomputer.

6. The improvement according to claim 5, and further including a second switch controlled by the control logic for controllably coupling the first and the second receiver of the control units to the serial to parallel converter and a third and fourth switch for coupling the first and the second transmitters respectively to its corresponding receiver and to the parallel to serial converter.

7. The improvement according to claim 6, and further including a further switch, operated by the control logic disposed between the first and second transmitters and the said third and fourth switches.

8. The improvement according to claim 1, and further including a test device coupled to the outputs of each of the first and second receivers of the control units for providing an output signal upon detecting of an error.

9. The improvement according to claim 1 wherein said receivers are electro-optical coupling elements.

10. The improvement according to 1 wherein said transmitters are switchable voltage or current sources.

* * * * *

UNITED STATES PATENT AND TRADEMARK OFFICE

CERTIFICATE OF CORRECTION

PATENT NO. : 4,398,851

DATED : August 16, 1983

INVENTOR(S) : Guy Geuns and Georg Rötzer

It is certified that error appears in the above—identified patent and that said Letters Patent is hereby corrected as shown below:

Column 6, lines 32 and 33 (claim 1, subparagraph (d)) change "preceding" to --following--

Signed and Sealed

*Fifth* Day of *November 1983*

[SEAL]

*Attest:*

DONALD J. QUIGG

*Attesting Officer*

*Commissioner of Patents and Trademarks*